US005516993A

United States Patent [19]

Wecke et al.

[11] Patent Number: 5,516,993

[45] Date of Patent: May 14, 1996

[54] SAFETY SWITCH

[75] Inventors: Rolf Wecke, Bückeburg; Roland Mönnings, Porta Westfalica; Ralph Hoppmann, Minden, all of Germany

[73] Assignee: Hans Bernstein Spezialfabrik für Schaltkontake GmbH & Co., Porta Westfalica, Germany

[21] Appl. No.: 339,496

[22] Filed: Nov. 14, 1994

[30] Foreign Application Priority Data

Nov. 15, 1993 [DE] Germany ..... 43 38 910.4

[51] Int. Cl.[6] ..... H01H 27/00

[52] U.S. Cl. ..... 200/17 R; 200/43.07; 200/61.62

[58] Field of Search ..... 200/17 R, 43.01, 200/43.04–43.09, 50 R, 50 A, 61.62–61.68, 334

[56] References Cited

U.S. PATENT DOCUMENTS 4,524,251 6/1985 Schulz ..... 200/42 R
4,658,102 4/1987 Seim et al. ..... 200/17 R
4,963,706 10/1990 Mohtasham ..... 200/334
5,464,954 11/1995 Kimura et al. ..... 200/61.62

*Primary Examiner*—J. R. Scott
*Assistant Examiner*—Michael A. Friedhofer
*Attorney, Agent, or Firm*—Henry M. Feiereisen

[57] ABSTRACT

A safety switch includes a housing having at least one opening and supporting a spring-biased tappet which is movable between two end positions by a switching mechanism including a switch wheel received in the housing. The switch wheel includes at each side a pair of separate but operatively interconnected resiliently mounted locking members. Each locking member carries a locking pin which is engageable in a bore of the surrounding housing. An actuator is insertable through the opening to act on ramp surfaces of the locking member, with the ramp surfaces being spaced from the grooves in the switch wheel. Thus, only a very particular actuator of complex configuration is suitable to effect the unlatching and subsequently the turning of the switch wheel for movement of the tappet from the initial position to a switching position.

15 Claims, 8 Drawing Sheets

SAFETY SWITCH

BACKGROUND OF THE INVENTION

The present invention generally refers to a safety switch, and in particular to a safety switch for effecting a shutdown of a current supply, for example when removing a protective cover from an appliance, a machine or the like or when opening an access door or the like.

Safety switches of this type conventionally include a housing in which a contact-bearing tappet is movably supported and acted upon by a switch wheel which is rotatably supported in the housing and turned by an actuator of adapted configuration for movement between an initial position and a switching direction. The housing has openings on two sides for insertion by the actuator, with the switch wheel including spring-biased locking members on both sides for locking a rotational movement of the switch wheel. The locking members are movable by the actuator in opposition to the spring force into a position releasing the switch wheel.

In order to meet safety demands, measures must be undertaken to prevent easy copying of the actuator for activating the switch through unauthorized persons or untimely or unintentional activation by an operator. Since upon manufacture of such safety switches their actual site and positioning of installation are generally not known, the safety switches are designed to allow activation by the actuator e.g. from two sides in order to minimize the required number of types of such safety switches and to render them consumer-friendly.

German Patent Nos. DE 31 00 862 C2 and DE 33 30 109 C2 disclose safety switches of this type in which the switch wheel is essentially split into two parts. A central part cooperates with the contacts-carrying tappet while lateral parts of the switch wheel are moved parallel to the pivot axis of the switch wheel in opposition of return springs by an actuator which is inserted through openings on two different housing sides in order to disengage stop members on the tappet from locking surfaces on the movable parts of the switch wheels. Thus, the locking members are formed by elements of the split switch wheel. Upon insertion of the actuator in one opening to activate the safety switch, the switch wheel is moved from a central position in one rotational direction while insertion of the actuator in the other opening results in a movement of the switch wheel in the other rotational direction. This means that the switch wheel is moved in different directions of rotation depending on which opening is used for the actuator.

Since the switch wheel itself assumes locking functions and, moreover, operates in two different directions of rotation depending on the insertion of the actuator into one or the other opening, the switch wheel requires many degrees of freedom. Evidently, the safety mechanism against unauthorized use or untimely actuation needs improvement. Also, the locking function is effected through locking with the movable, resiliently mounted tappet. This fact and the fact that the switch wheel is turned from a central position in either direction of rotation involves certain factors of uncertainty for the safety switch, in particular when resorting to force to activate the safety switch.

German utility model DE-GM 76 27 192 describes a further safety switch, with a housing provided with openings for allowing actuation in two different directions. When changing the direction of rotation, the entire switching mechanism must be dismantled and reassembled in the other position. Moreover, the overall construction is relatively simple and dimensioned for many degrees of freedom so that the manipulation safety needs improvement.

In accordance with a further known safety switch (WO 91/10247) which includes a switch wheel which cooperates with the tappet, with locking members being arranged laterally of the switch wheel. The locking members are movable parallel to the pivot axis of the switch wheel and are lockingly engageable in the switch wheel. Activation of the safety switch is evidently possible only in one direction. The actuator and both lateral locking members are of simple configuration so that the manipulation safety needs also improvement.

SUMMARY OF THE INVENTION

It is an object of the present invention to provide an improved safety switch obviating the aforestated drawbacks.

In particular, it is an object of the present invention to provide an improved safety switch which can be activated by an actuator through insertion from several initiation directions at a very high manipulation safety, including safety against use of force.

These objects, and others which will become apparent hereinafter, are attained in accordance with the present invention by providing the switch wheel on each side with a pair of independent but operatively linked locking members which extend at an angle to each other, with one locking members being associated to one opening for an actuator and with the other locking member being associated to the other opening for the actuator, and with the locking members slidably arranged radially to the pivot axis of the switch wheel and including locking pins which cooperate with the surrounding housing area.

Suitably, the housing is provided with two openings on two different housing sides. Yet, the locking members for securing the switch wheel are still characterized by a very small degree of freedom because only one locking member is acted upon on each side of the switch wheel for activation of the safety switch, so that the locking members need only be configured and positioned with regard to one direction of initiation. The arrangement of the locking members on the lateral end faces of the switch wheel is essential because the locking members are turned together with the switch wheel upon its actuation. Thus, rotation of the switch wheel necessitates not only a displacement of the locking members into the unlatched position but also requires to maintain the locking members in a depressed state during rotation of the switch wheel. Therefore, the provision of an actuator of highly complicated configuration is required which receives its manipulation safety from its three-dimensional configuration. It is impossible to copy such an actuator by simple mechanical means or by using other substitutes. Thus, a spatially three-dimensional manipulation safety function is created.

In contrast to conventional locking elements arranged laterally of the switch wheel, the safety switch according to the present invention has locking members which are integrated within the switch wheel so that the actuator opening can be designed relatively narrow and with only a width in accordance with the width of the switch wheel. During constant depression of the locking members in the unlatched position, the switch wheel is allowed to rotate in direction of actuation without experiencing a blockage between the actuator and the switch wheel. This further contributes to a highly complicated three-dimensional configuration of the actuator which must have respective clearances for rotating the switch wheel. Moreover, since the width of the actuator opening is small, the use of substitute tools which are slantingly inserted through the opening will make it impossible to act upon the locking members on both sides and, at the same time, to turn the switch wheel. This would require an additional third manipulation which cannot be executed by a user alone. The radial mobility of the locking members relative to the pivot axis of the switch wheel allows numerous possibilities for configurations to create a very high manipulation safety, especially with regard to the complexity of design of the actuator.

Since during insertion of the actuator through one opening, the locking member of each pair which is associated to the other opening is moved as well, so that each side includes two locking pins, i.e. overall a total of four locking pins, which are engageable in the surrounding housing areas for effecting the locking operation. This results in a superior safety mechanism against use of force. It is practically impossible to disengage by force four separate locking members which are located at different locations at the housing. Moreover, since the actuator acts upon the switch wheel at a point of application in the area of its outer circumference and the locking with the housing is also effected at this outer location, a use of force, especially a violent force, will not result in additional lever arm to increase the potential for destruction.

In accordance with a further feature of the present invention, each of the four locking members is associated with a separate return spring so as to quadruple the safety mechanism.

Suitably, the switch wheel, after unlatching the locking members by means of the actuator, is always rotated with regard to the tappet in a same direction between an initial position and an end position which are defined by stops. This further greatly contributes to the manipulation safety and in particular the safety against use of force because in each position the switch wheel has only a single degree of freedom of movement.

In accordance with a further preferred embodiment of the present invention, the areas of the locking members cooperating with the adapted actuator are positioned spatially offset backwards relative to the areas of the switch wheel cooperating with the actuator. A manipulation in particular with a relatively simple U-shaped element as actuator is impossible because the nature of the configuration of the present invention ensures that the crossbar of such an element would act only upon on the effective surface of the switch wheel but would be unable to reach the locking members without any additional and complicated adaptation.

According to another preferred feature of the present invention, the switch wheel is placed with its locking members and its support inside a hood which is connectable into the remaining housing portion in two positions turned by about 180°. Thus, the hood together with the entire switching mechanism can be selectively attached to the housing to offer the safety switch with openings for insertion of the actuator in four different positions. There is no need of modifying or dismantling the switching mechanism. During change of attachment of the hood to the housing, the switch wheel is secured in position by the locking pins which engage bores in the surrounding wall surface of the hood.

In order to eliminate penetration of contaminations or hardenable materials into the interior of the safety switch which would otherwise jeopardize the operation, the actuation opening which is not in use is tightly sealed by a plug.

BRIEF DESCRIPTION OF THE DRAWING

The above and other objects, features and advantages of the present invention will now be described in more detail with reference to the accompanying drawing in which.

FIGS. *6a* and *6b* are simplified cross sectional views of the switch wheel.

DETAILED DESCRIPTION OF PREFERRED EMBODIMENTS

Figure 1:
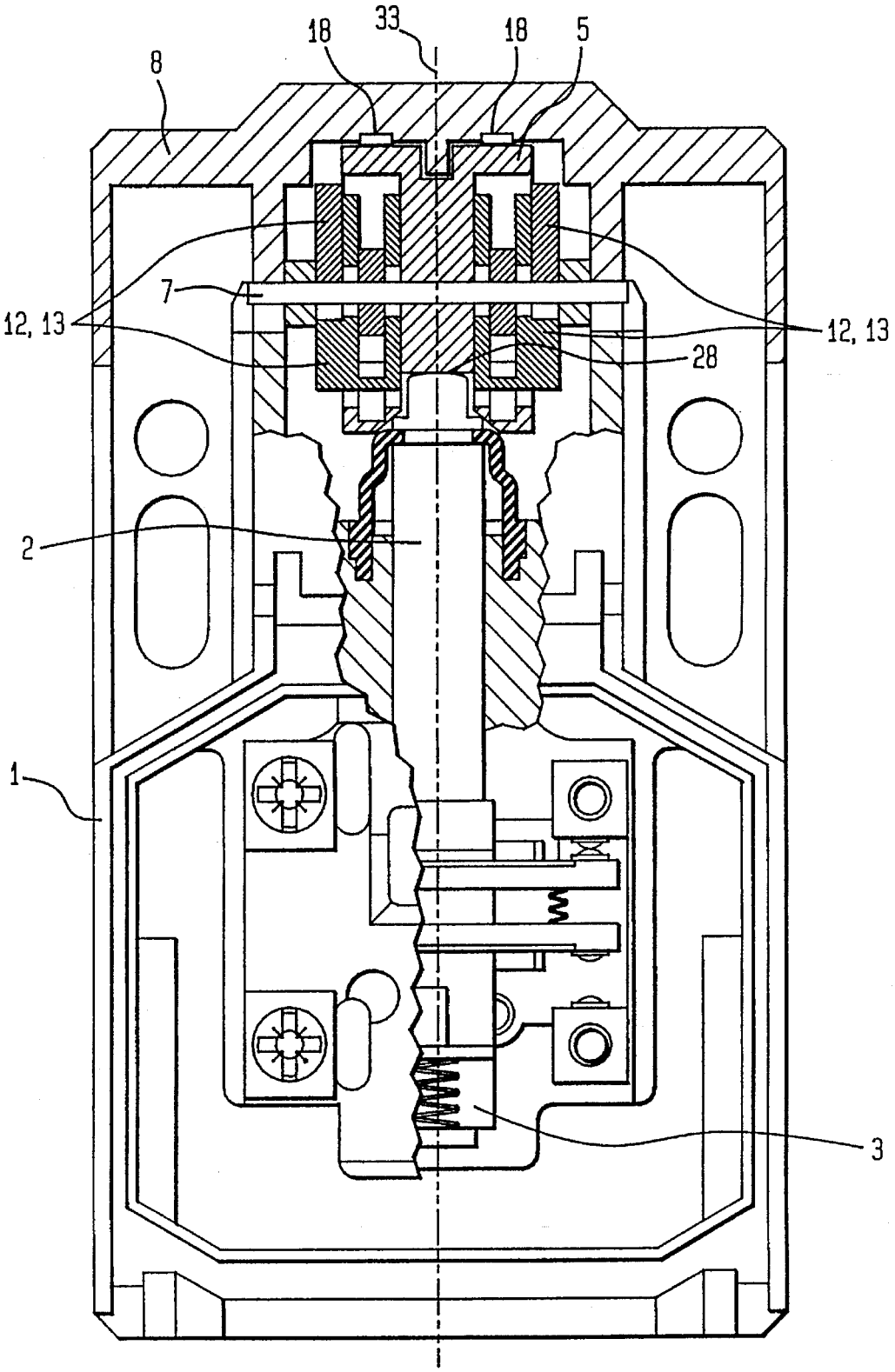
FIG. 1 is a side view of one embodiment of a safety switch according to the present invention.

Throughout all the Figures, the same or corresponding elements are always indicated by the same reference numerals.

Turning now to the drawing, and in particular to FIG. 1, there is shown a side view of one embodiment of a safety switch according to the present invention, with a housing 1 accommodating a conventional switching circuit which is not described in detail. A switching tappet 2 extends vertically within the housing 1 and is slidably guided against the force of a spring 3. Actuation of the tappet 2 can only be executed by a specially designed actuator 4 via a particular switching mechanism which will be described in more detail with reference to FIG. 2. A hood 8 is detachably secured to the housing 1 via a snap-on connection 9 (FIG. 3) and accommodates the entire switching mechanism.

Figure 2:
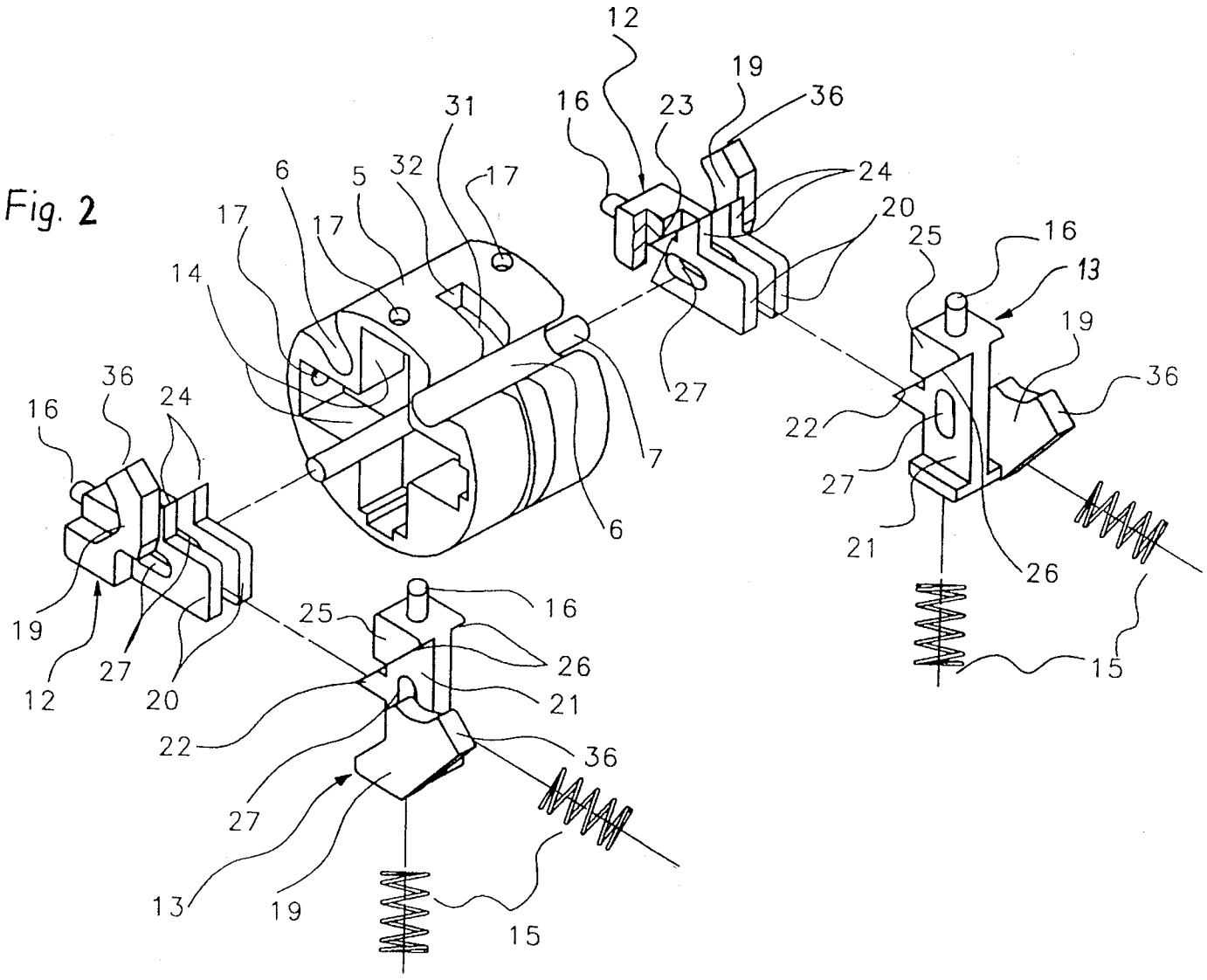
FIG. 2 is an exploded illustration of a safety switch according to the present invention, with the housing being removed and with the switch wheel and the locking mechanism being illustrated in detail.

Turning now to FIG. 2, there is shown an exploded illustration of the safety switch according to the present invention, illustrating in particular the switching mechanism which includes a switch wheel 5 provided with two radial grooves 6 which are angularly spaced from each other by about 90° and respectively engageable by the actuator 4 for rotating the switch wheel 5 from an initial position into a switching position. The switch wheel 5 is rotatably mounted on a axle 7 which is secured in the hood 8.

Figure 3:
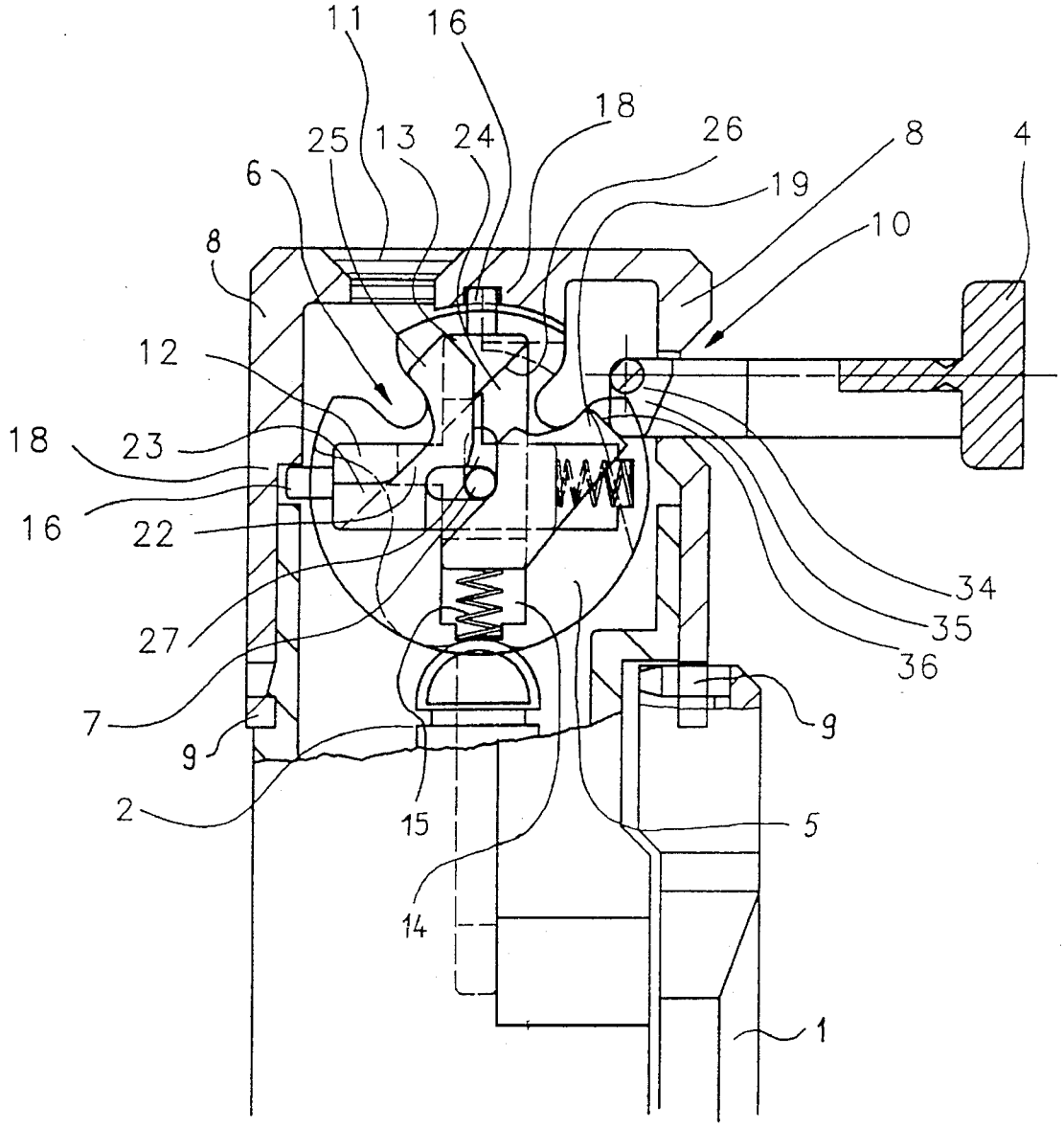
FIG. 3 is a schematic, partially sectional view of the upper area of the safety switch, with the switch wheel in locked position.

As shown in particular in FIG. 3, the top and one side of the hood 8 is provided with an initiation opening 10 for insertion by the actuator 4. As stated above, the hood 8 incorporates the entire switching mechanism and thus can be easily detached from the housing and re-attached in another position turned by 180° so that a total of four different locations for insertion by the actuator 4 are offered, with the switching mechanism being securely fixed during such a positional change. A plug 11 is provided to tightly seal the opening 10 which is not in use for preventing contamination of the interior of the switching mechanism.

As best seen in FIG. 2, the switch wheel 5 is provided on each end face with a pair of separate but operatively interconnected locking members 12, 13 which are received in pockets 14 arranged in crosswise configuration in which the locking members 12, 13 are guided for radial displacement with regard to the pivot axle 7. Associated with each of the locking members 12, 13 is a return spring 15 so that the locking mechanism is still functioning when one of the two return springs 15 of each pair of locking members 12, 13 is defective. Each locking member 12, 13 includes at one axial end a locking pin 16. Associated to the thus four locking pins 16 are bores 17 in the outer surface of the switch wheel 5. In the initial locked position of the switch wheel 5, each bore 17 is in alignment with a receiving bore 18 in the adjacent area of the hood 8, with the springs 15 forcing the locking pins 16 through the bores 17 into the bores 18 of the hood 8 to securely fix the switch wheel 5 and to prevent any rotation thereof.

The locking member 12 of each pair of locking members 12, 13 is provided at its side facing outwards with a key element 19 which is provided with a ramp surface 36 for cooperation with the actuator 4 inserted through the respective one of the openings 10. In a similar manner, the locking member 13 is provided with a key member 19 in opposition to the key member 19 of the locking member 12 and including a ramp surface 36 for cooperation with the actuator 4 when being inserted in the other one of the opening 10.

Attached to one side of the key element 19 of the locking member 12 is a forked piece 20 which forms a receptacle for an insertable web 21 of the other locking member 13. The web 21 of the locking member 13 is provided with a forwardly protruding bevel 22 which cooperates with a beveled sliding surface 23 in the base of the forked piece 20 of the locking member 12. Each fork arm of the forked piece 20 is also provided with a protruding bevel 24. The locking member 13 is provided with a head piece 25 which carries the locking pin 16 and projects laterally beyond the web 21, with the head piece 25 being provided at its underside with beveled sliding surfaces 26 which coact with the protruding bevels 24 of the locking member 12. The web 21 of the locking member 13 and both fork arms of the forked piece 20 of the locking member 12 are provided with aligned oblong holes 27 which are traversed by the axle 7.

In an assembled state, both locking members 12, 13 extend at an angle of 90° to each other within the pockets 14. The web 21 of the locking member 13 engages the forked piece 20 of the locking member 12, with the protruding bevels 22 of the locking member 13 bearing upon the bevels 23 of the forked piece 20 while the protruding bevels 24 bear upon the fork arms of the locking member 12 along a section of the beveled sliding surfaces 26 of the head piece 25 of the locking member 13.

During assembly, both locking members 12, 13 can be pushed into each other such that they are insertable laterally into the pockets 14 of the switch wheel 5, with the locking pins 16 being sufficiently retracted to also fit into the pockets 14. Thereafter, the springs 15 push the locking members 12, 13 outwards so that the locking pins 16 traverse the bores 17 in the switch wheel 5 and enter the bores 18 in the surrounding hood 8. Thereafter, the pivot axle 7 is pushed through the switch wheel 5 and prevents in combination with the respective dimensioning of the oblong holes 27 that the locking members 12, 13 are pressed together too far to disengage the locking pins 16 from the switch wheel 5.

Figure 6A:
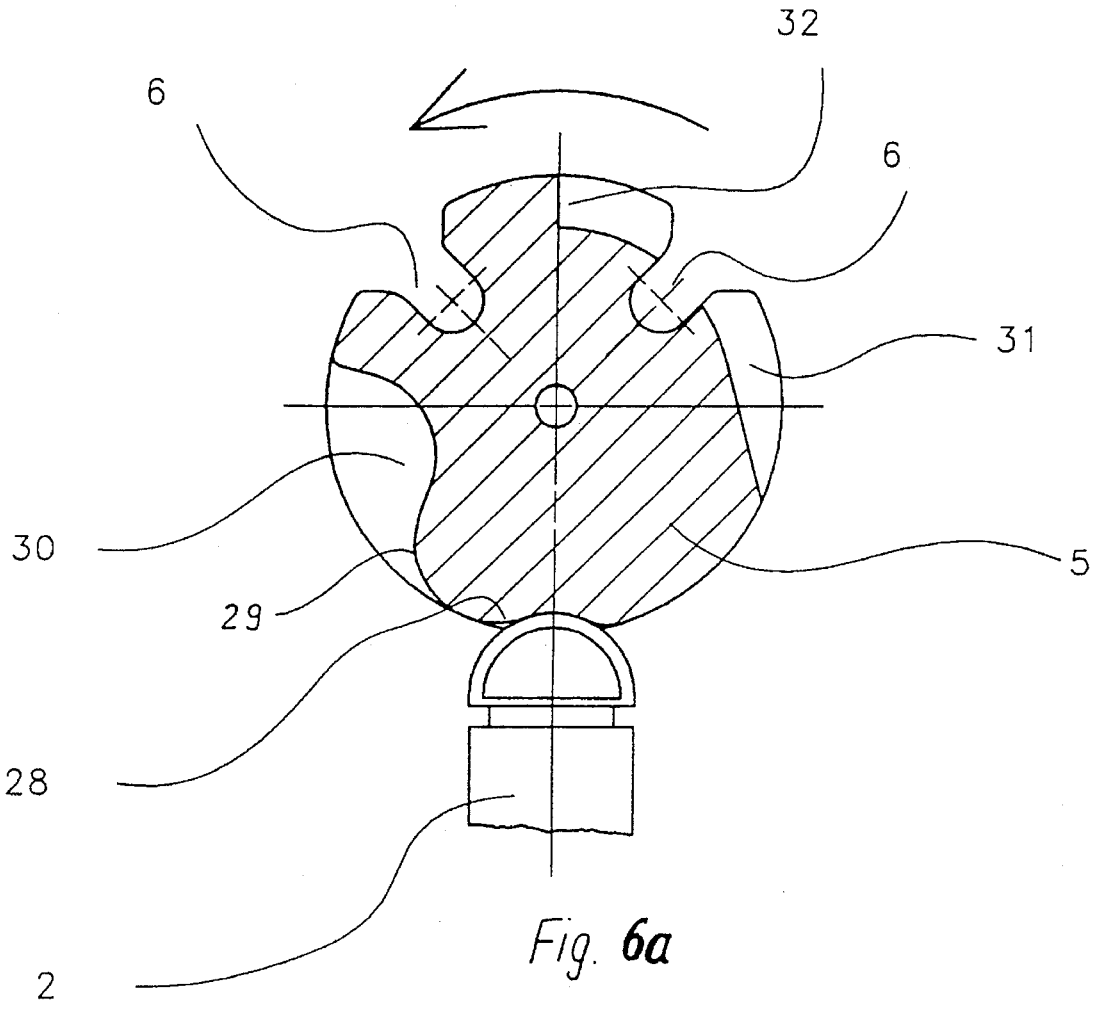

The outer jacket of the switch wheel 5 form in the central area a cam surface for actuation of the tappet 2. In the initial position, as shown in FIG. 6*a*, the spring-biased tappet 2 engages a small central, circumferential recess 28 which is spaced from a significantly deeper circumferential recess 30 via a cam section 29. The recess 30 represents the switching position of the tappet 2 and allows a deeper penetration of the tappet 2 within the switch wheel 5, i.e. the tappet 2 is moved axially upwards to effect a switching state.

The switch wheel 5 is further provided in this central area with a flat groove 31 which has an end wall 32 for formation of a stop member to effect a further locking of the switch wheel 5 in one rotational direction when being in the initial position. Engaging the groove 31 is a small projection 33 which is formed on the inside of the hood 8 at a respective location. During rotation, the switch wheel 5 is guided along the projection 33 within the groove 31.

Figure 4:
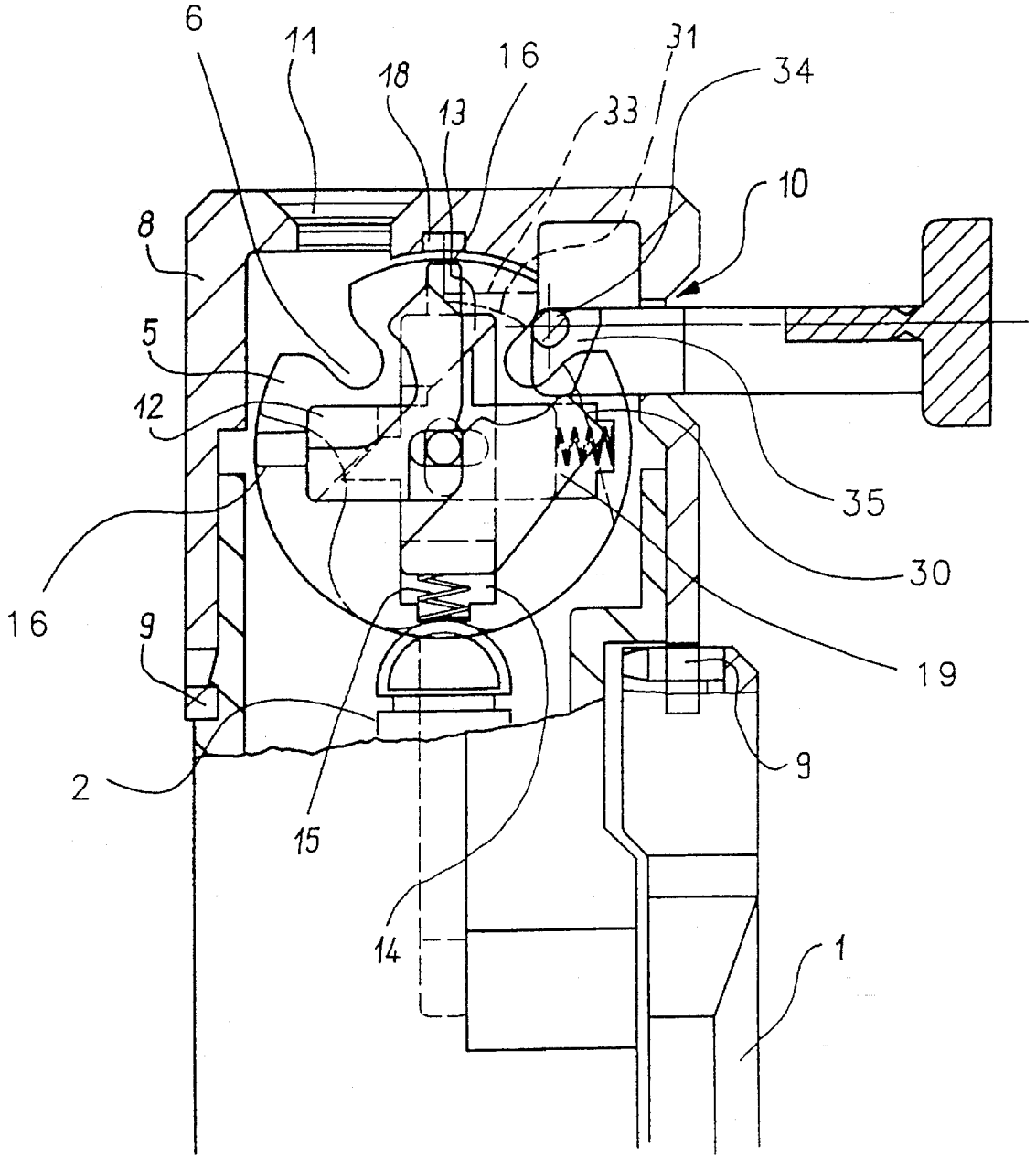
FIG. 4 is a schematic, partially sectional view of the upper area of the safety switch, with the switch wheel being unlocked through insertion by an actuator.
Figure 7:
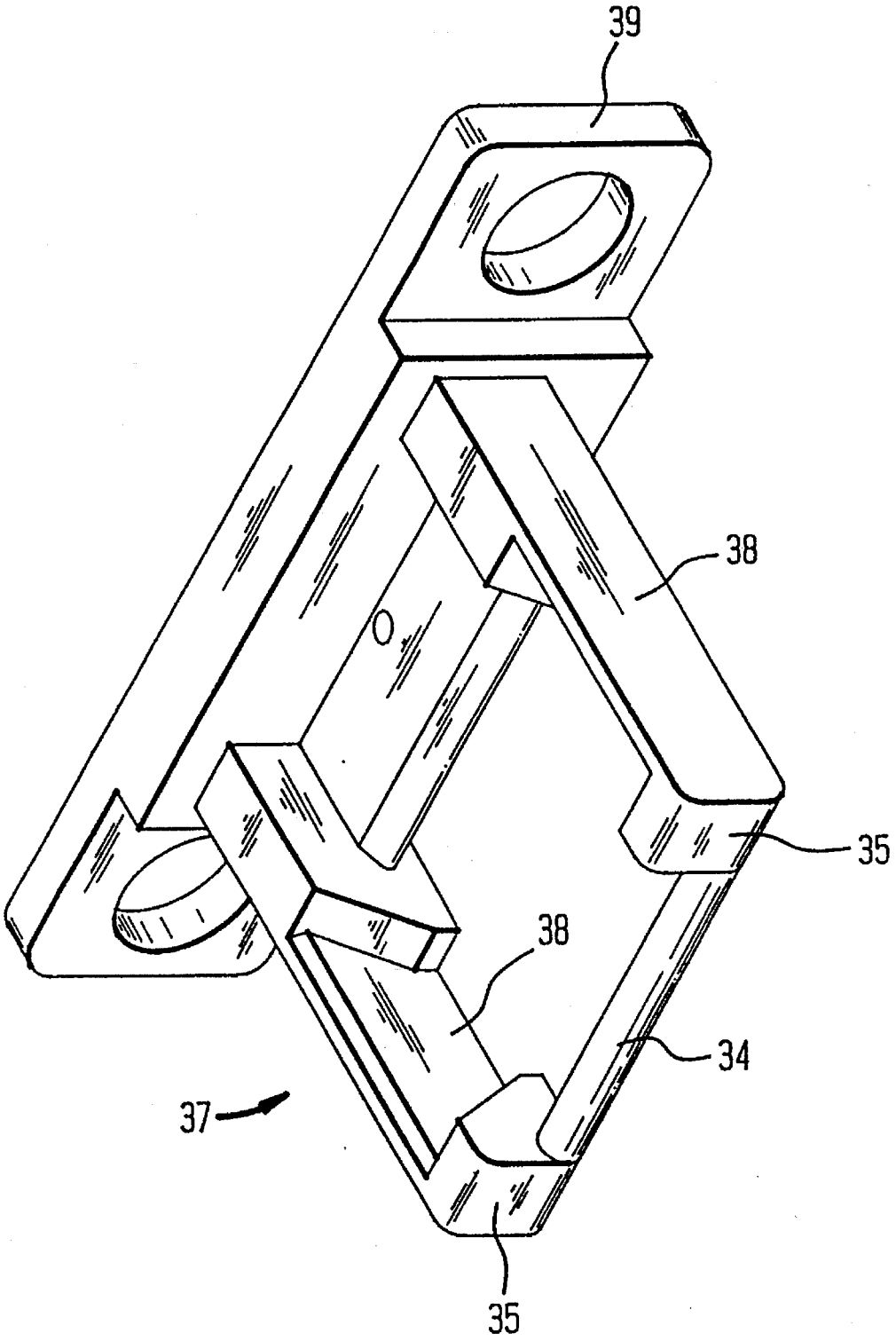
FIG. 7 is an exemplified, perspective view of an actuator for use with the safety switch according to the present invention.

The unlatching of the switch wheel 5 and the switching of the tappet 2 will now be described in more detail with reference to the FIGS. 3, 4 and 5, with FIG. 3 showing the switch wheel in fully locked position, in which the springs 15 are fully extended so that the locking pins 16 are received in the bores 18 of the hood 8 and the switch wheel 5 is secured against rotation. In the exemplified illustration of FIG. 3, the lateral initiation opening 10 in the hood 8 is exposed and ready to receive the actuator 4. As best seen in FIG. 7, there is illustrated an exemplified perspective view of the actuator 4 which is a special tool with a protruding area in form of a stirrup, generally designated by reference numeral 37 and having a crossbar 34 which cooperates with the switching mechanism and two shanks 38 with particular contact pieces 35 in the forward area. The stirrup 37 is secured to a base 39 which is mounted to a moving object such as door, shutter or the like. In the locked initial position of the switch wheel 5, as shown in FIG. 3, the ramp surfaces 19 of the locking members 12, 13 extend offset backwards to the radial grooves 6 of the switch wheel 5, which cooperate with the crossbar 34 of the actuator 4 so that unlatching is effected only by the particular additional contact pieces 35 on the actuator 4. The contact pieces 35 act on the ramps 36 of the key members 19 of the locking members 13 so that upon further insertion of the actuator 4, the locking members 13 are pushed backwards against the force of the springs 15 radially to the axle 7 and in the pockets 14 of the switch wheel 5, as shown in FIG. 4. Since the locking member 12 is interlocked with the locking member 13 via the complementary protruding bevels 24 and 26, the locking member 12 is also moved backwards until the locking pins 16 withdraw from the bores 18 of the hood 8 to complete the unlatching of the switch wheel 5.

In case the other opening 10 on the top of the hood 8 is used for insertion of the actuator 4, the contact pieces 35 act upon the ramps 36 of the key members 19 of the locking member 12 which is thus pushed back, with the locking member 13 following the motion via the coacting bevel 22 of the locking member 13 and the bevel 23 at the base of the forked piece 20 of the locking member 12.

Figure 5:
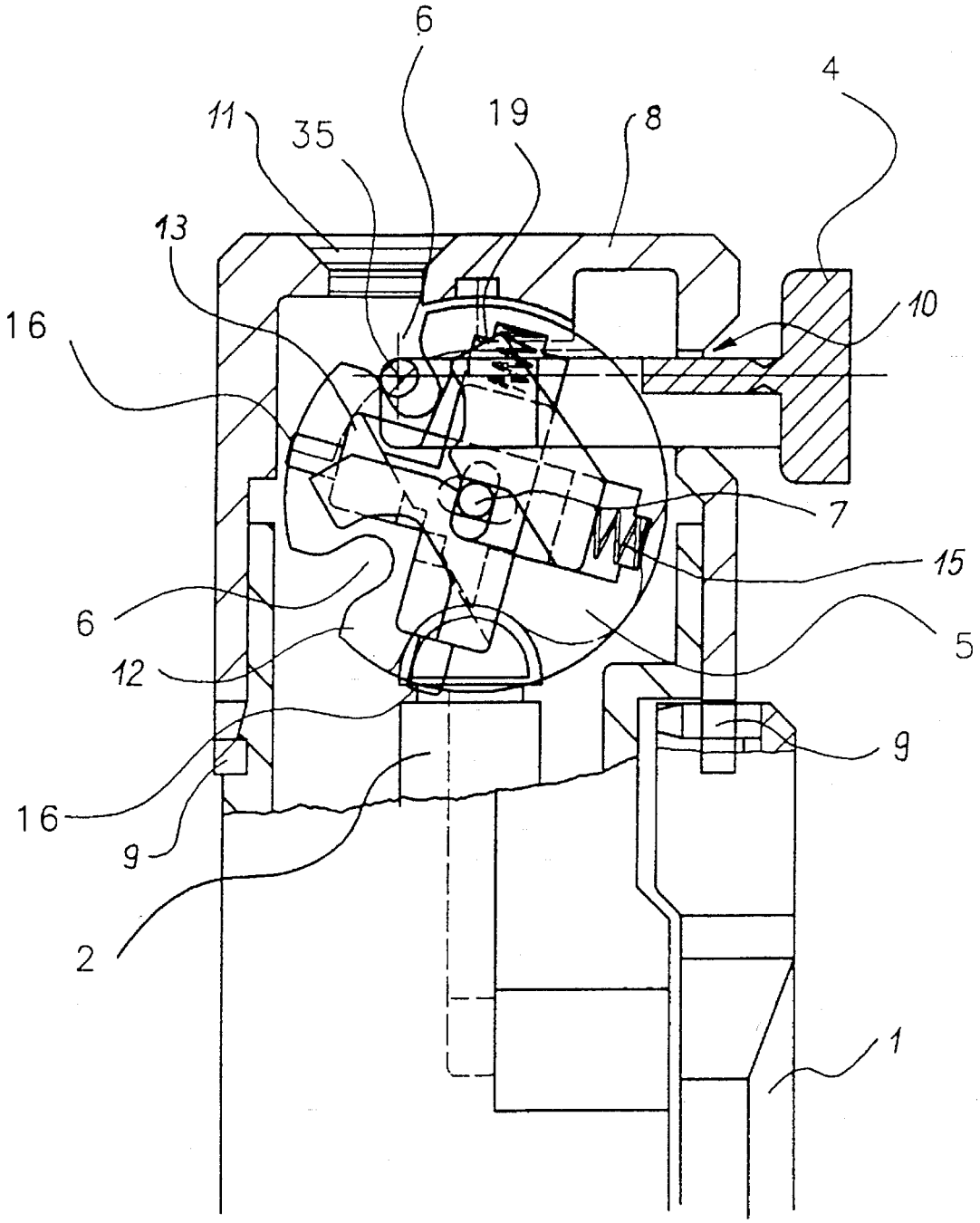
FIG. 5 is a schematic, partially sectional view of the upper area of the safety switch, with the switch wheel being further rotated by the actuator to occupy the switching position.
Figure 6B:
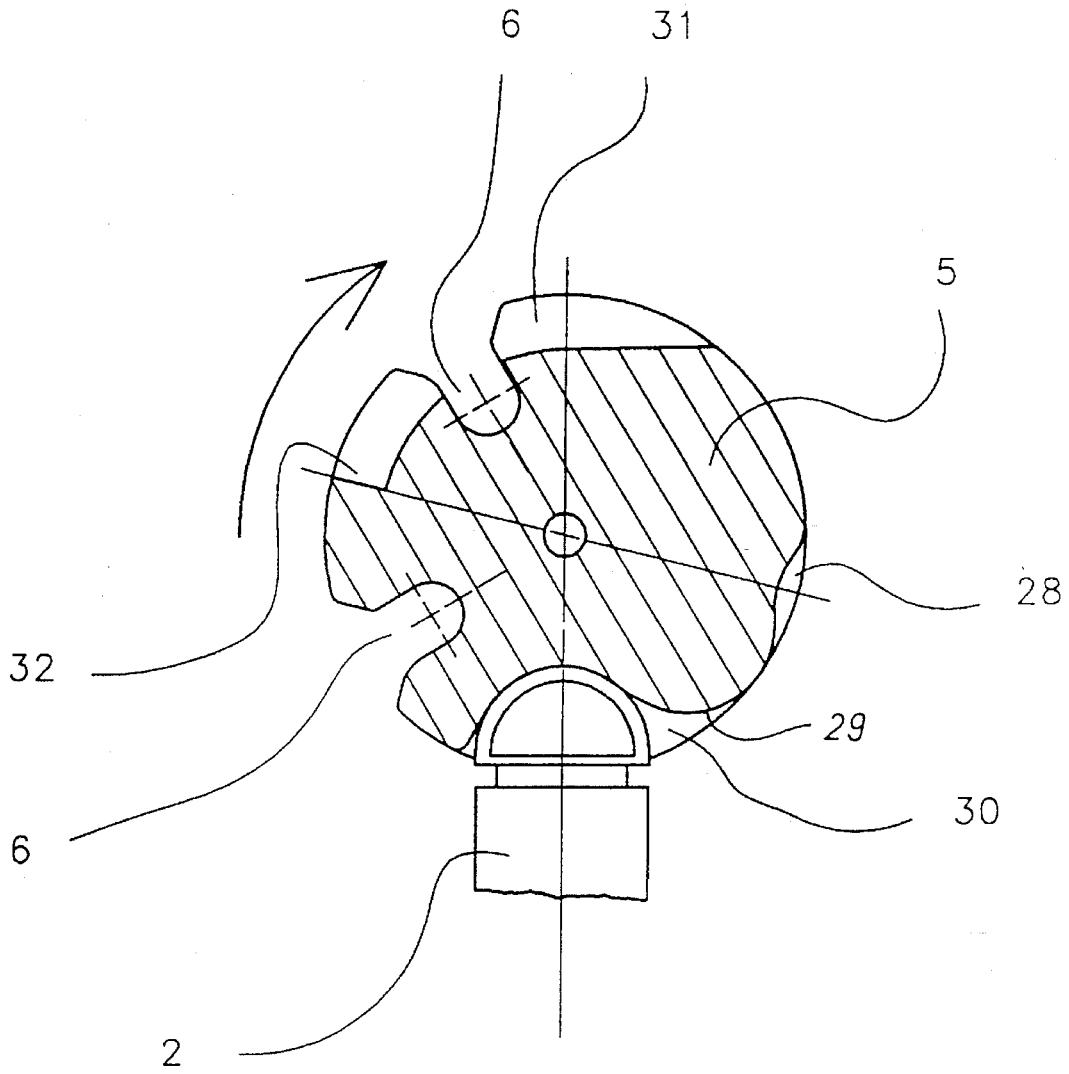

After fully unlatching the switch wheel 5, the actuator 4 is pushed deeper into the opening 10 so that the crossbar 34 of the actuator 4 strikes against the opposing wall of the radial groove 6 to enable a turning of the switch wheel 5, as shown in FIG. 5. Through rotation of the switch wheel 4, the recess 28 is moved away from the engagement area with the tappet 2 which then slides along the cam 29 until engaging the deeper recess 30, as shown in FIG. 6*b*. In this position, a switching is effected.

Even when using the other opening 10 for the actuator 4, the switch wheel 5 is always turned in a same direction of rotation. This is true also when turning the hood by 180° and attaching the hood 8 in the other position onto the housing 1 so that the lateral opening is now positioned on the opposite side while the opening on the top is moved to the right.

The actuator 4 according to the invention can be configured without any pointed ends or sharp edges so that a part of a human body e.g. a hand cannot be injured when closing a door or the like between the actuator and the safety switch.

While the invention has been illustrated and described as embodied in safety switch, it is not intended to be limited to the details shown since various modifications and structural changes may be made without departing in any way from the spirit of the present invention.

What is claimed as new and desired to be protected by Letters Patent is set forth in the appended claims:

We claim:

1. A safety switch, comprising:

a housing having at least one opening;

a spring-biased tappet supported in said housing and movable between two end positions;

a switch wheel received in said housing and rotatable about a pivot axis between an initial position and a switching position, said switch wheel acting upon said tappet for moving said tappet between the end positions in correspondence to said initial and switching positions;

an actuator engageable in said opening for turning said switch wheel between the initial position and the switching position; and locking means arranged on each side of said switch wheel for controlling rotation of said switch wheel, said locking means including a pair of separate but operatively interconnected locking members which extend at an angle to each other and are movable radially toward said pivot axis, with each said locking member having a locking pin engaging in respective bores of said housing.

2. The safety switch of claim 1 wherein said locking means includes return springs, each said locking member being separately biased by one of said return springs.

3. The safety switch of claim 1 wherein said at least one opening of said housing is formed as two openings, said actuator moving said switch wheel in a same direction of rotation for actuation of said tappet from an initial position regardless of the selection of said openings for engagement by said actuator.

4. The safety switch of claim 1 wherein said switch wheel has an end wall acting as a stop in one direction of rotation when said switch wheel is in the initial position.

5. The safety switch of claim 1 wherein said switch wheel has an outer surface provided with a groove, said housing having a projection engaging said groove for guiding said switch wheel during rotation, with said groove having one end forming a stop for the initial position of said switch wheel.

6. The safety switch of claim 1 wherein said switch wheel has a surface area acted upon by said actuator, each of said locking members including a surface area actuated by said actuator and extending backwards from said surface area of said switch wheel.

7. The safety switch of claim 1 wherein said housing has a lower housing part and a hood, said hood accommodating said switch wheel together with said locking members and pivot axis and being connectable to said housing part in two positions which are offset by about 180°.

8. The safety switch of claim 1 wherein said switch wheel has opposing end faces provided with pockets in the form of a cross for receiving and movably guiding said locking members radially with regard to said pivot axis, said locking means including at least one return spring received in said pockets for biasing each pair of locking members, said switch wheel having peripheral bores for engagement by said locking pins.

9. The safety switch of claim 1 wherein said switch wheel has a central area provided with a first circumferential recess of small depth for engagement by said tappet in the one end position, and a second circumferential recess of greater depth which is angularly spaced from said first circumferential recess, with said first and second circumferential recesses being connected via a control cam.

10. The safety switch of claim 1 wherein said locking members are provided with key members having ramp surfaces cooperating with said actuator.

11. The safety switch of claim 10 wherein said switch wheel has radial grooves, said ramp surfaces of said key members being situated backwards with regard to said grooves, with said actuator having a crossbar for engagement in said grooves and lateral contact pieces acting on said ramp surfaces of the key members.

12. The safety switch of claim 1 wherein one of said locking members has a forked element provided with fork arms and defining a base, the other one of said locking members having a head piece and a web engaging said forked element and including a first protruding bevel cooperating with a bevel at the base of said forked element, said fork arms of said forked element having a second protruding bevel cooperating with a beveled sliding surface underneath said head piece of the other one of said locking members.

13. The safety switch of claim 1 wherein each of said locking members has an oblong hole for receiving said pivot axis when fitting said locking members into each other.

14. The safety switch of claim 1, further comprising a plug for tightly sealing said opening.

15. The safety switch of claim 1 wherein said actuator is of U-shaped with a crossbar and front contact pieces, without pointed ends or sharp edges.

* * * * *

UNITED STATES PATENT AND TRADEMARK OFFICE

CERTIFICATE OF CORRECTION

PATENT NO. : 5,516,993

DATED : May 14, 1996

INVENTOR(S) : Rolf Wecke, Roland Mönnings & Ralph Hoppmann

It is certified that error appears in the above-indentified patent and that said Letters Patent is hereby corrected as shown below:

Claim 3, column 7, line 45, change "as" to --by--.

Signed and Sealed this

Third Day of December, 1996

*Attest:*

Bruce Lehman

BRUCE LEHMAN

*Attesting Officer*

*Commissioner of Patents and Trademarks*